US005217134A

United States Patent [19]

Saunders

[11] Patent Number: 5,217,134

[45] Date of Patent: * Jun. 8, 1993

[54] CONVENIENCE-FEATURE END CLOSURE FOR CONTAINER BODY WITH NON-CYLINDRICAL SIDEWALL

[75] Inventor: William T. Saunders, Weirton, W. Va.

[73] Assignee: Weirton Steel Corporation, Weirton, W. Va.

[ * ] Notice: The portion of the term of this patent subsequent to Feb. 14, 2006 has been disclaimed.

[21] Appl. No.: 535,413

[22] Filed: Jun. 8, 1990

[51] Int. Cl.[5] ..... B65D 17/40

[52] U.S. Cl. ..... 220/276; 220/271; 220/273

[58] Field of Search ..... 220/270, 271, 273, 276, 220/716, 718

[56] References Cited

U.S. PATENT DOCUMENTS

| | | | |
|---|---|---|---|
| 4,044,915 | 8/1977 | LaCroce et al. | 220/270 |
| 4,386,713 | 6/1983 | Baumeyer et al. | 220/269 |
| 4,804,106 | 2/1989 | Saunders | 220/273 |
| 4,848.623 | 7/1989 | Saunders et al. | 220/273 |
| 5,038,956 | 8/1991 | Saunders | 220/271 |

*Primary Examiner*—Stephen P. Garbe
*Assistant Examiner*—Nova Stucker
*Attorney, Agent, or Firm*—Raymond N. Baker

[57] ABSTRACT

Methods and apparatus for forming a convenience-feature, sheet metal end closure structure (133) for a container body (153) having a non-cylindrical side wall. A new scoring tool (94) configuration enables a peripheral scoreline (102) defining a separable convenience-feature panel (112) to be located contiguous to the closure chuck wall (100) which interfits about its entire periphery with the open end of the side wall of such a container. Separation of such panel leaves substantially no obstruction to removal of solid-pack container. The separable panel (112) is formed with a multiple-layer fold (127) of sheet metal which is nested against the interior periphery of such panel, so as to shield torn residual metal remaining with the panel after severance along such peripheral scoreline. And, preselected placement of an elongated integral openers (148) as designated on various noncircular configuration endwall panels, along with novel shaping of chuck wall tooling (170), enables desired chuck wall support for chime seam assembly of such sheet metal end closure to a container body.

5 Claims, 6 Drawing Sheets

FIG. 1 PRIOR ART
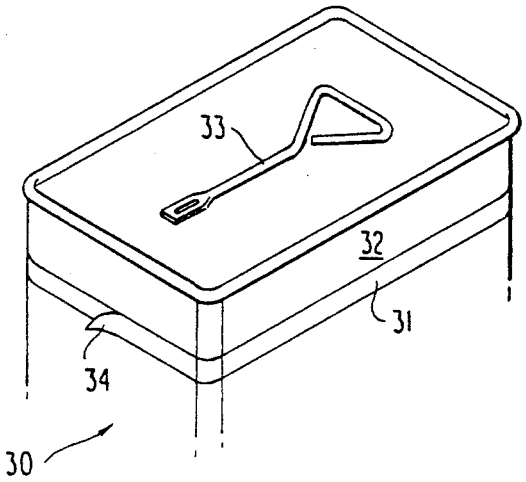
FIG. 2 PRIOR ART
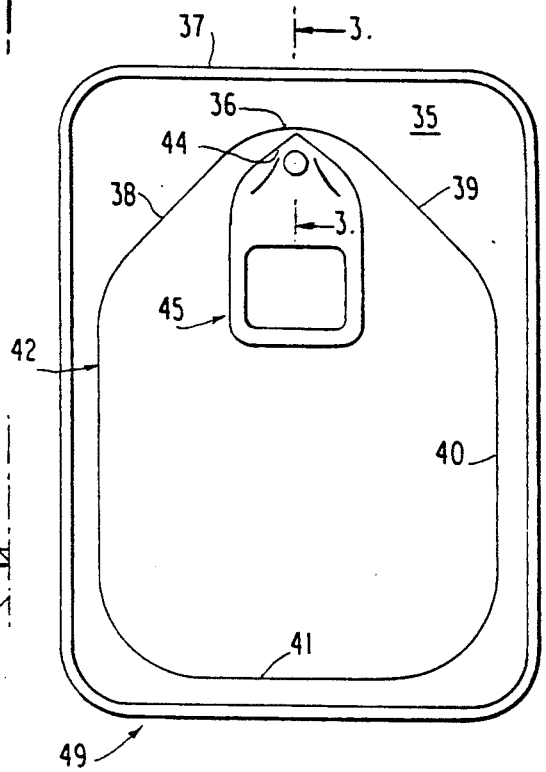
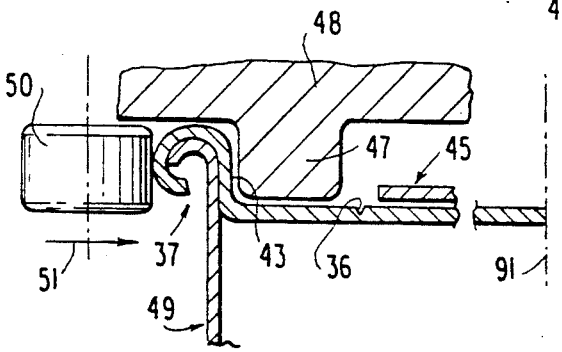
FIG. 3 PRIOR ART
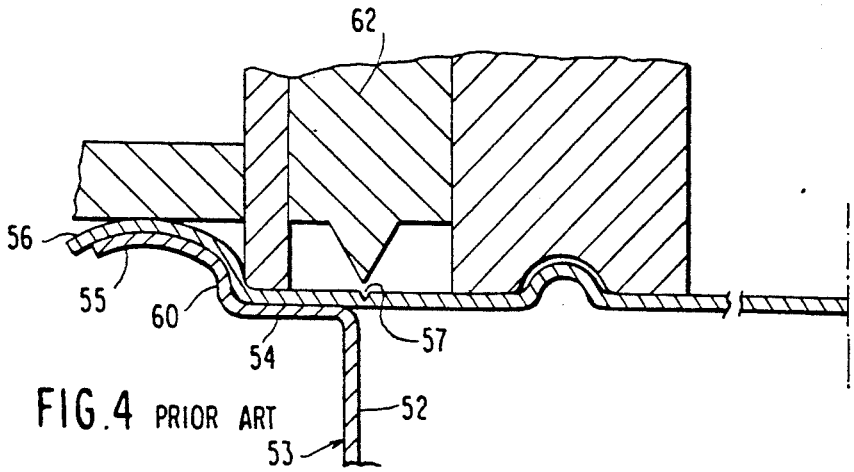
FIG. 4 PRIOR ART FIG. 5
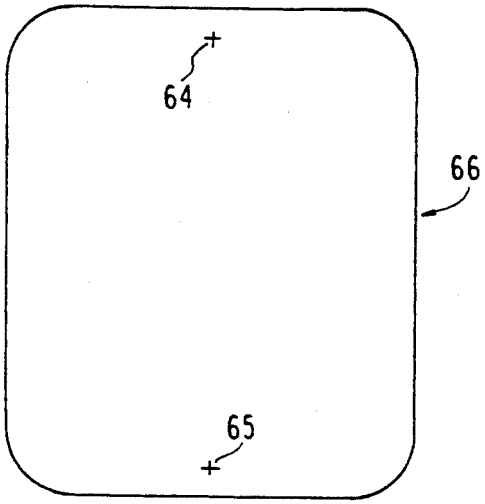
FIG. 6
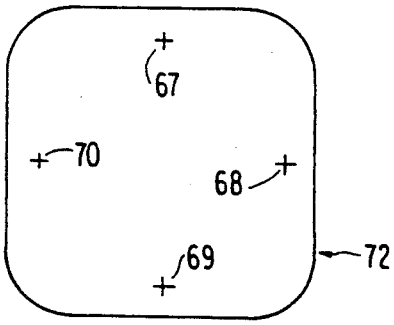
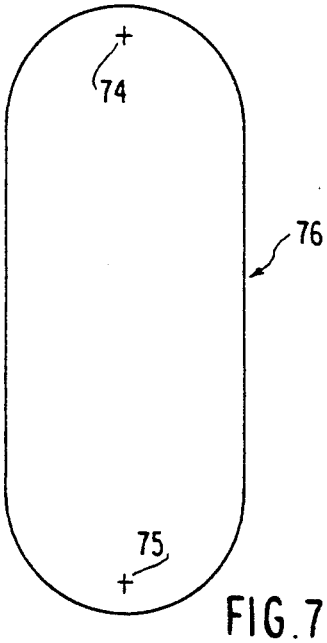
FIG. 7
FIG. 8
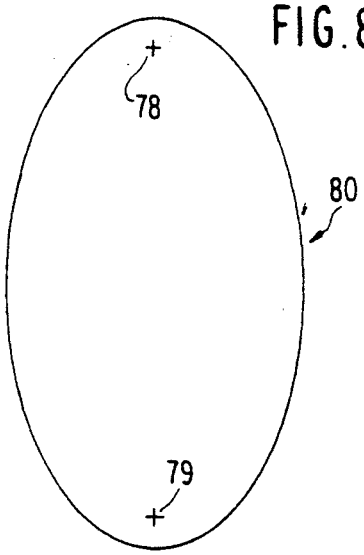
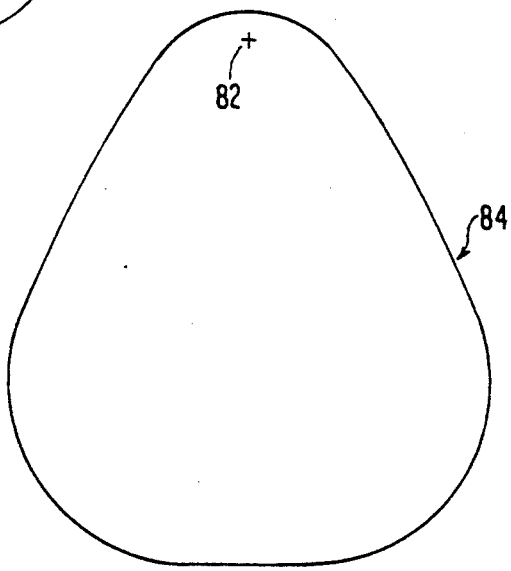
FIG. 9

FIG. 22
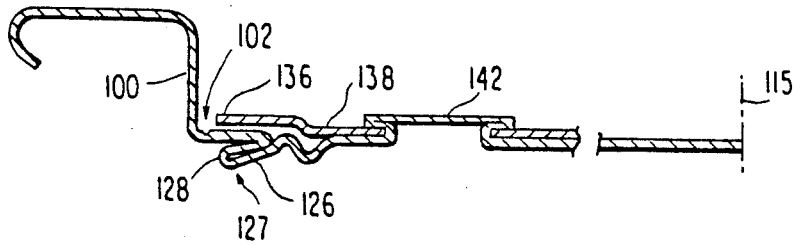
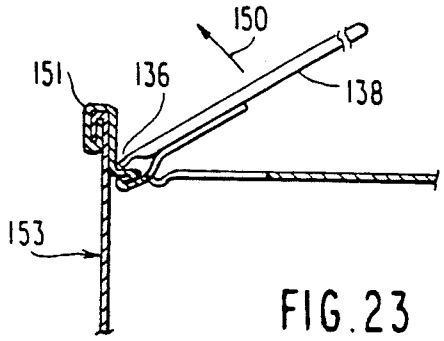
FIG. 23
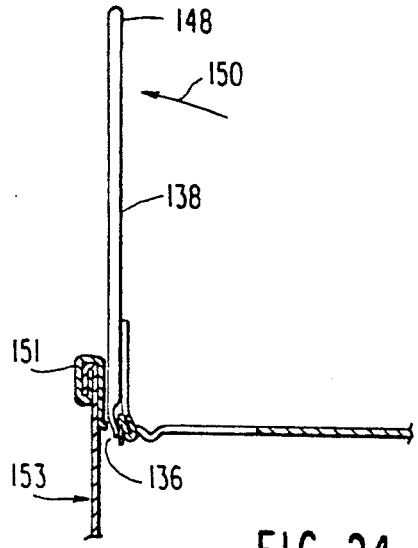
FIG. 24
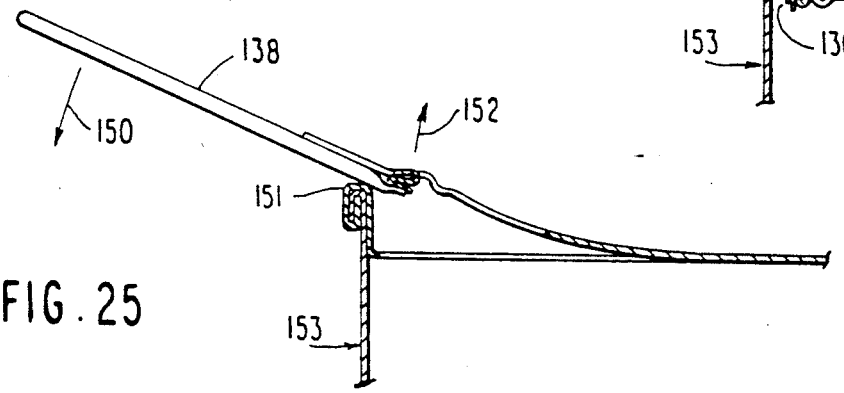
FIG. 25
FIG. 26
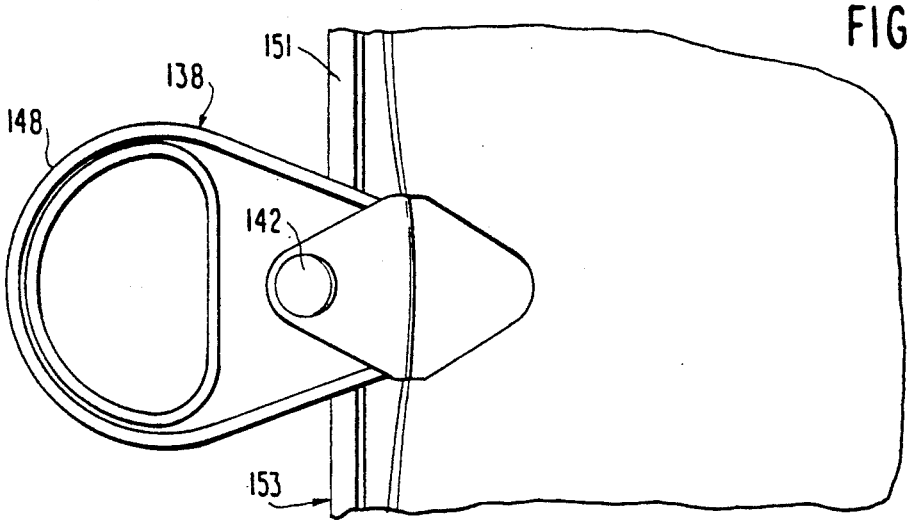

FIG. 27
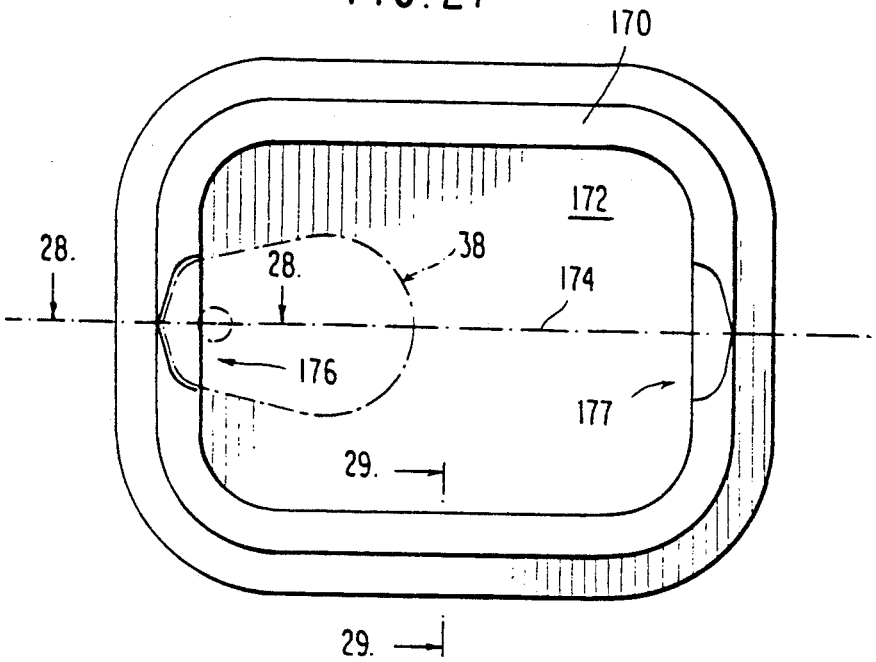
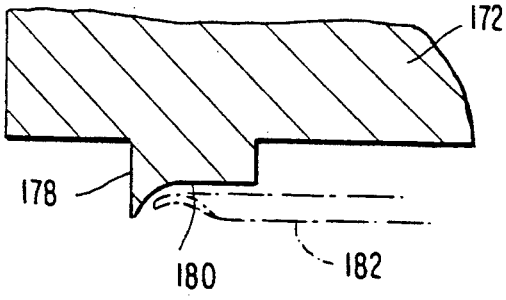
FIG. 28
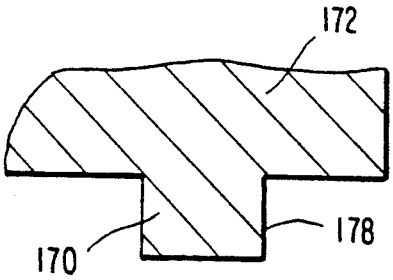
FIG. 29

CONVENIENCE-FEATURE END CLOSURE FOR CONTAINER BODY WITH NON-CYLINDRICAL SIDEWALL

This invention relates to sheet metal end closures and methods and apparatus for fabricating sheet metal convenience-feature end closure structures which enable "solid-pack" removal of container contents. More particularly, the invention is concerned with convenience-feature end closures for container bodies having preselected non-cylindrical side wall configurations; and, further, with measures to substantially eliminate hazards to safety during opening and use of sheet metal convenience-feature end closures for packaging solids.

Solid-pack removal of, for example, corned beef product has been dependent on use of a scored strip extending around the container side wall. A slotted key is attached to the distal end tab of a scored strip which is severed to divide the container into two cup-shaped parts. The contents are available as a solid-pack, but, the edges of the severed strip and side walls on both cup-shaped parts present potential hazards to safety during opening and /or removal of contents.

The present sheet metal end closure structures, and methods and means for fabricating such convenience-featured structures, enable unobstructed removal of solidpack contents and substantially eliminate torn edge metal hazard during and after opening such a container.

The above and other contributions of the present invention, as well as prior practices, are described in more detail in relation to the accompanying drawings, in which;

FIG. 1 is a perspective partial view of a prior art solid-pack container which relies on side wall severance;

FIG. 2 is a top plan view of a can showing a prior art easy-open structure with endwall panel scoreline and integral opener;

FIG. 3 is a schematic, cross-sectional, partial view along the lines 3—3 of FIG. 2 for describing prior art tooling and orientation for forming a chime seam between an end closure and the open end of a container body;

FIG. 4 is a schematic, cross-sectional, partial view for describing a prior easy-open approach to solid-pack removal of container contents which relies on substantial increase in cross-sectional dimensions at the end of the container to be opened;

FIGS. 5 through 9 are schematic plan views of end closure configurations (for container bodies having noncylindrical side walls) for describing teachings of the invention relating to blank orientation and preselected locations for integral openers in accordance with the invention;

FIG. 22 is an enlarged cross sectioned view along the line of 22—22 of FIG. 20:

FIGS. 23 through 25 are schematic cross-sectional partial view for describing container opening procedures utilizing for the present invention;

FIG. 26 is a top plan partial view of container structure for further describing the lever-action opening resulting when the handle end of the opener is "over-the-side" with the chime seam of such container acting as a fulcrum;

FIG. 27 is a bottom plan view of tooling of the invention for backing up the chuck wall during chime seam attachment of an end closure structure to a container body;

FIG. 28 is an enlarged partial cross-sectional view taken along the lines 28—28 of FIG. 27, and FIG. 29 is a partial cross-sectional view taken along the lines 29—29 of FIG. 27.

Figure 10:
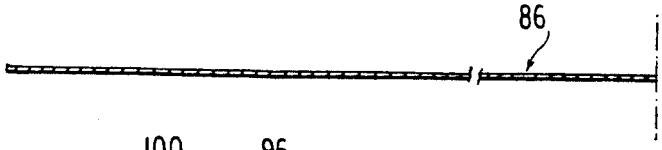
FIG. 10 is a "cut-edge" partial view (side view in elevation) of a flat-rolled sheet metal blank for forming an end closure for a container.

The prior art corned beef can 30 of FIG. 1 has a narrow-width scored strip 31 extending around the full perimeter of its rectangular cross section side wall 32. In a well known manner, a slotted key 33, which accompanies the assembled can, is fitted over tab 34 on strip 31 and, the key is rotated to open container 30.

Removal of the scored side wall strip 32 enables solid-pack removal of container contents; that is, it is possible to remove the contents as a single piece without relying on such solid contents being frangible. But, severed raw edge metal of the severed scorelines is exposed on both edges of the strip and on both side wall edges.

The prior art easy-open end closure on the noncylindrical can body shown in FIGS. 2 and 3 has been dependent on the contents being separable or frangible; for example, such type has typically been used for seafood parts, such as sardines, anchovies, or the like. An endwall panel 35 is scored, as illustrated in FIG. 2, with initial rupture location 36 being in spaced relationship (in the plane of panel 35) from chime seam 37. From such initial rupture location 36, the scoreline extends along angled legs 38, 39; and, in spaced relationship from chime seam 37 along the longer dimension (as represented at 41) of the rectangular configuration end closure.

Closed scoreline 42 (which defines the removable panel) remains spaced from the chime seam 37 throughout its length. Referring to the partial view in cross section of FIG. 3, chuck wall 43 extends from the upper level of chime seam 37 to recessed panel 35. In such prior art, it was essential that the working end 44 (FIG. 2) of an integral opener 45 be spaced, in the plane of the endwall, from such chuck wall 37 so as to provide access for chuck 47; the latter is part of tooling 48 for providing back-up support during closing of seam 37 about the upper chime of container 49 using seam roller 50. Such FIG. 3 forming operation as well as the force required as seam roller 50 acts in the direction indicated by arrow 51 to inter-curl and roll the perimeter metal of the end closure and the flange material of the container body to form a chime seam 37 are known in the art. Tooling 48 presents a wall support chuck 47 in order to provide backing in a direction opposite to that of arrow 51 during such shaping of perimeter metal of the end closure.

Another prior art approach to an easy-open end closure is shown in the schematic, cross-sectional, partial view of FIG. 4. The container flange is extended outwardly beyond the cross-sectional profile of side wall 52 at the open end of can body 53. Such approach involve use of an outwardly projecting ledge 54 and, in addition, utilizes flange metal 55 at the open end of can body 53.

Flange metal 55 is used to form a seam with perimeter metal 56 of an end closure. Endwall scoring of such an end closure structure is located at 57 (FIG. 4) so that the scoreline is disposed slightly inboard of the profile of the inner surface of side wall 52 to enable an opener and endwall panel metal to turn inwardly of the container without obstruction at the transition zone between sidewall 52 and ledge 54.

Scoreline 57 could be formed with a conventional scoring tool, such as 62 which is symmetrical in cross-sectional view, about its centrally-located axis which extends through the scoring edge of tool 62 into scoreline 57.

Shortcomings of the type of prior art end closure shown in FIG. 4 include abuse problems with such ledge and other extended cross-sectional dimension portions of the container body during fabrication and during handling for fabrication and filling. Also, metal economics is a disadvantage since added metal is required for both the can body and end closure.

However, a unique scoring knife and other concepts of the present invention enable endwall panel scoring to take place contiguous to the container side wall profile (as projected in plan view onto the end closure) so as to provide for solid-pack removal. As part of such concepts, severed edge metal remaining with the container is about the same as that resulting from use of a "roll-knife" can opener on a conventional end so that convenience-feature opening of a panel-periphery scoreline does not add any hazard to user safety at such location.

It is further within the scope of the invention to provide for shielding of severed edge metal on the separated non-circular endwall panel. Other contributions of the invention involve improved ease of opening and separating a full-panel endwall from a container having a non-cylindrical side wall.

Non-cylindrical side wall container bodies, along with end closures which are non-circular in plan view, are partially described in the Dewey and Almy Can Dimension Dictionary (Dewey and Almy Chemical Division, W. R. Grace Company, Cambridge, Mass. 02140); page 3 of that text points out that "All non-circular ends—(with exception of square ends)—have two dimensions, a longer dimension and a shorter dimension."

The present invention is particularly concerned with non-circular end closure structures for container bodies having non-cylindrical side walls. The non-circular end closure configurations of the invention are selected from the group consisting of "rectangular" (FIG. 5), "square" (FIG. 6), "oblong" (FIG. 7), "elliptical" (FIG. 8), and "pear-shaped" (FIG. 9).

A further concept of present teachings which facilitates blank handling, blank fabrication, and opening of convenience-feature end closures involves pre-selection of rivet button locations for riveting an opener to a separable endwall panel. As taught herein, the rivet button (as well as, or the resulting rivet) is located along a major dimensional centerline axis (in plan view) of the end closure configuration; for other than the "square" configuration, such centerline axis is along the longer dimension for such end closure.

For example, as taught herein an integral opener rivet can be located at 64 or 65 on the rectangular end closure 66 of FIG. 5; at positions 67, 68, 69 or 70 on the square configuration end closure 72 of FIG. 6; at positions 74 or 75 on the"elliptical" end closure 76 of FIG. 7; and, at 78 or ;79 on the elliptical"end closure 80 of FIG. 8.

However, a single potential position is selected at 82 for the "pear-shaped" end closure 84 of FIG. 9. Such "pear-shaped" configuration, or an end closure have configurational characteristics similar to that of FIG. 9 (that is, with smaller and larger longitudinal ends) simplifies registry problems during entry into and feed through forming press stations such that a single rivet location is designated.

In the configurations of FIGS. 5, 7, 8, and 9, the preselected rivet location is located along the centerline which divides the blank (and end closure) into equal halves along the longer dimension. In the "square" configuration end closure 72 FIG. 6, the potential locations for an integral opener rivet are preselected at opposite ends of either equal centerline dimension axis, each of which divides the blank and end closure in half. With all such configurations (FIGS. 5 through 9) of the invention, the dimensional axis relied on divides the end closure into equal mirror-image halves; that is, no diagonal or minor axis are selected.

Preselection of possible rivet locations (FIGS. 5 through 9) for integral openers, as taught herein, facilitates handling during fabrication of cut blanks into end closure shells; and, also provides for desired placement of an elongated integral opener with the longitudinal axis of the opener coincident with that of the end closure centerline axis selected (this longitudinally coincident relationship means that the major dimensional axis and the longitudinal axis of the opener are in the same plane which includes the central height axis of the container).

Further, such preselection enables location of peripheral scoring for an endwall panel contiguous to the chuck wall of the end closure structure while providing for chuck wall support during formation of a chime seam during assembly of a container; such combination contributes to making solid-pack removal of container contents through an endwall panel attainable and practicable.

In the shell-forming stage, during fabrication of a flat metal blank (FIG. 10) into an end closure, chime seam metal 87 (FIG. 11) is adjacent the "cut-edge" perimeter of such blanks. Endwall panel 88 is countersunk forming chuck wall 90 which is oriented axially inwardly toward such recessed panel 88; that is, in a direction toward the interior for an assembled container. The chuck wall fits within the side wall at the open end of the container body so as to close such open end; the profile (plan) view of each has the same dimensional and configurational characteristics (such plan view being in a plane which is perpendicularly transverse to the central height axis for such a container).

The prior art requirements for spacing the panel and for spacing the working end of an integral opener from the chime seam, have been described in relation to FIGS. 2 through 4. However, as taught herein an elongated integral opener is positioned initially and is secured in place with its working end contiguous to the end closure chuck wall. The invention enables such placement from the beginning without sacrificing back-up support for the chuck wall during chime seam formation.

Also, the longitudinal axis of the elongated opener is located coincident with the selected major dimensional axis of the end closure as described above. In each configuration of FIGS. 5 through 9, the dimensional axis selected bisects the rivet securing an elongated opener to the closure and, also for reasons related to facilitating opening as described later bisects the peripheral scoreline at the side of the end closure which is preselected.

Two possible rivet locations are available in all but the "square" configuration of FIG. 6 (which provides four possible rivet locations) or the single possible location 82 as designated for a rivet in the "pear-shaped" configuration 94 of FIG. 9. The possible preselections taught herein, are important for purposes of work product orientation during fabrication of an end closure, during placement of convenience features and during assembly of a container; also, they are important to facilitating convenience-feature opening.

Figure 11:
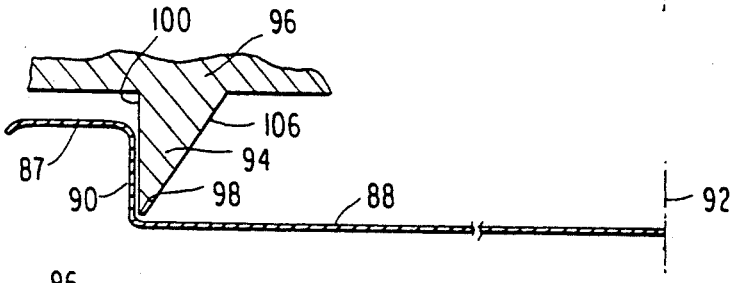
FIG. 11 is a partial view in cross section, of a shell formed from the blank of FIG. 10 along with a scoring tooling for describing an operation in accordance with the invention.
Figure 12:
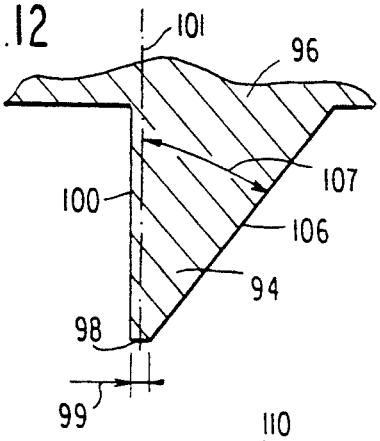
FIG. 12 is an enlarged cross section view of a scoring knife of the invention.
Figure 13:
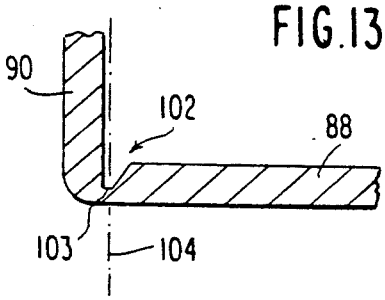
FIG. 13 is an enlarged view of a sheet metal portion of FIG. 11 for describing the scoreline resulting from use of the scoring knife of FIG. 12.
Figure 14:
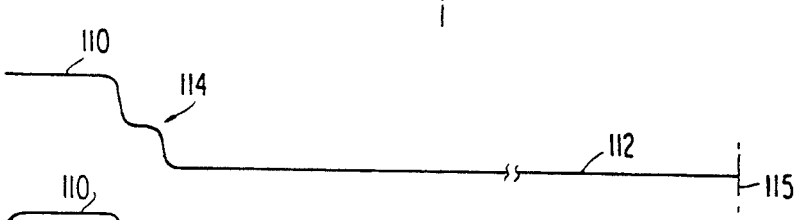
FIGS. 14 through 19 are schematic partial views, in cross section, for describing sequential forming steps for an embodiment of the invention.

FIGS. 11 through 13 are concerned with peripheral scoreline formation and FIGS. 14 through 19 are concerned with a sequence of steps for shaping a sheet metal blank into an end closure and forming a peripheral scoreline which defines the endwall panel to be separated.

The juxtaposition between scoring tooling and end closure for external surface scoring is shown in FIG. 11 in a cross-sectional plane which includes the central height axis 92. The unique configuration of the scoring knife 94 portion of scoring tool 96 is shown in greater detail in FIG. 12. This configuration enables the scoring knife 96 to operate contiguous to chuck wall 90.

Scoring knife 96 is truncated at its working edge 98 with a dimension (measured as indicated at 99 in such cross-sectional plane) selected between about 0.001" to 0.002" for typical consumer-use size containers such as the 303×208 inch end closure for a corned beef container; (303 refers to 3 3/16" for the longer dimension and 208 refers to 2 8/16" for the shorter dimension).

Scoring knife side wall 100 abuts chuck wall 90 and is perpendicular (or substantially perpendicular with a few degrees of divergence away from the central height axis 92) to such truncated edge 98, in the cross-sectional view shown; that is, scoring knife side wall 100 is substantially parallel to the contiguous surface of such chuck wall permitting relative movement between the scoring tooling and the end closure chuck wall along the direction of axis 101 for the scoring knife 94; such axis bisects scoring edge 98.

The resulting peripheral scoreline, shown at 102 in FIG. 13, has an axis 104, which bisects the maximum depth portion 103 of the scoreline 102. Such mid-point of maximum-depth portion 103, where rupture occurs, is coincident with the direction of relative movement along axis 101 of scoring knife 94 of FIG. 12. Where rupture occurs can thus be positioned within less than 0.001" to about 0.0015" from such chuck wall (as measure in plan view of such end closure) by utilizing a scoring knife configuration taught with a truncated working edge dimension between about 0.001" and 0.002".

In the cross section shown, the configuration of the scoring knife 94, as it protrudes from the pad portion of scoring tool 96, presents essentially a truncated version of a right-angled triangle with hypotenuse side 106 at an angle of about 30° (indicated by 107 in FIG. 12) with the axis of movement of the scoring tool.

Such scoring knife configuration extends around its full plan view configuration enabling the peripheral scoreline for the end closure to be contiguous to the chuck wall along its full length; and, such location does not interfere with other adjacent convenience-feature structures during scoring.

The resulting favorable safety feature is that residual scoreline metal on that portion of the end closure which remains with the container body after separation of endwall panel 88 is about the same as that remaining after severance of a convention end using a conventional "roll-knife" can opener which has not presented substantial hazard to consumer users.

Wall 106 of scoring knife 94 (FIG. 12) provides desired stability between the working edge 98 and the pad portion of scoring tool 96.

Referring to FIGS. 14 through 19, a flat-rolled metal blank (such as 86 of FIG. 10) is formed into a shell by shaping perimeter metal 110 as shown and countersinking endwall panel 112. A stepped configuration 114 (as viewed in cross section in a plane which includes the center height axis 115) is utilized for such countersinking.

Figure 15:
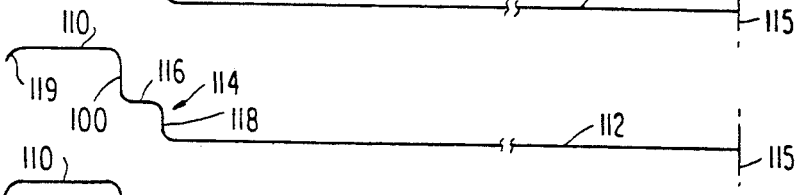

In FIG. 15, the desired right-angled relationship between chuck wall 100 and a "tread" portion 116 of the stepped configuration 114 is shown; "rise" portion 118 of such stepped configuration is oriented substantially perpendicular to endwall panel 112). The distal edge of perimeter metal 110 is curled as shown at 119 during such orientation of chuck wall 100 and "tread" 116.

Figure 16:
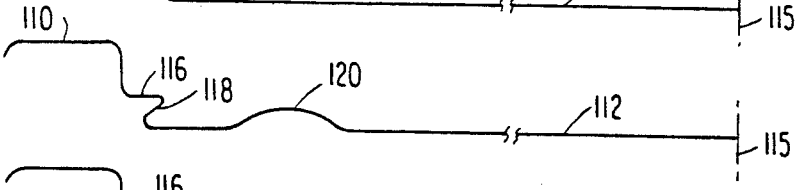

In FIG. 16, a broad-based dome 120 for a rivet button is formed in the endwall panel 112; and, a sheet metal folding action is initiated with the metal in rise portion 118 of the stepped configuration 114 taking the angled relationship shown. Such folding action is started by moving recessed endwall panel 112 toward perimeter metal 110. This starts formation of a multi-layer fold of sheet metal for protection of the raw edge metal remaining with the endwall panel when the peripheral scoreline is severed.

Figure 17:
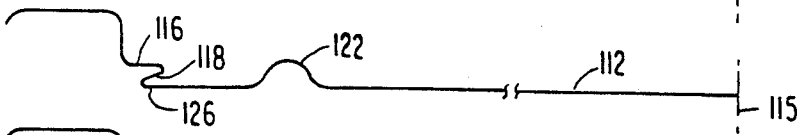

In FIG. 17, a second, narrower cross-section, increased height, rivet button dome 122 is formed as the folding action continues; original rise portion 118 is being moved into closer relationship with tread portion 116; and, a perimeter portion 126 of endwall panel 112 is being moved into the multi-layer fold relationship.

Figure 18:
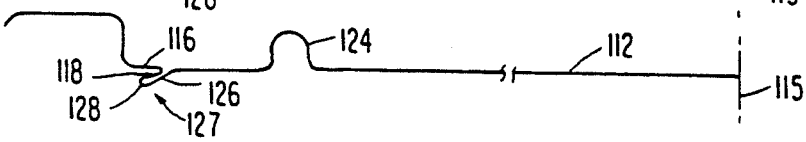

As shown in FIG. 18, the final rivet button configuration 124 is formed as the multiple layers of sheet metal, including perimeter portion 126 of the endwall panel 112, are being moved to near completion of a multi-layer fold 127 which defines a rounded-edge 128; the latter to be positioned in plan view to shield residual scored metal after rupture along the peripheral scoreline for the severable endwall panel.

Figure 19:
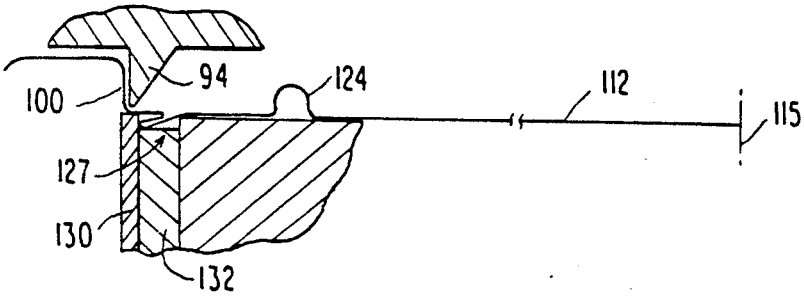

In FIG. 19, tooling 130 (for providing backing during scoring) is positioned, as shown, as scoring knife 94 completes impression of the peripheral score 102 described earlier in relation to FIGS. 12 and 13. The multi-layer fold 127 is nested by relying in part on tooling 132, to have its rounded edge portion 128 oriented to be contiguous to the profile of the mid-point of the maximum depth portion of peripheral scoreline being formed.

Figure 20:
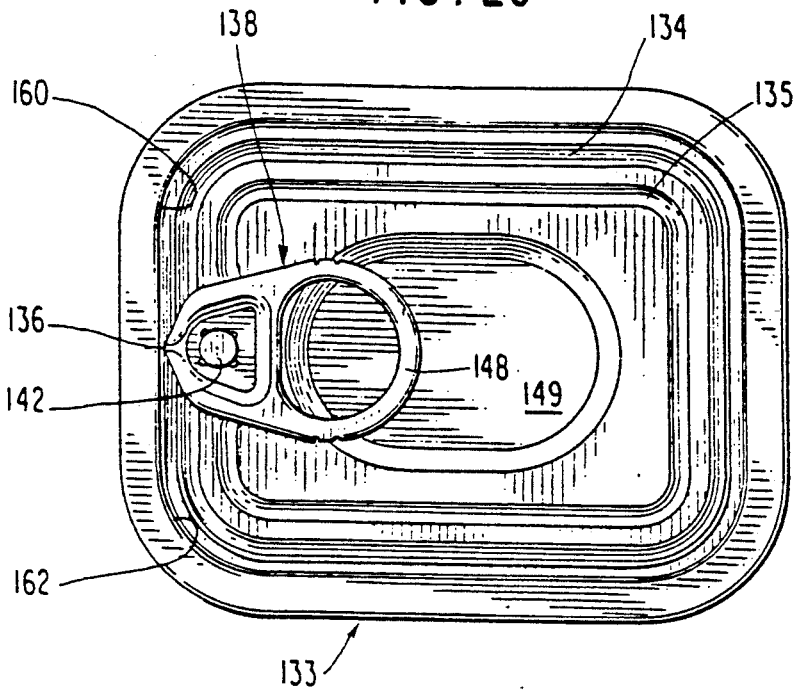
FIG. 20 is a top view of an end closure structure of the invention.
Figure 21:
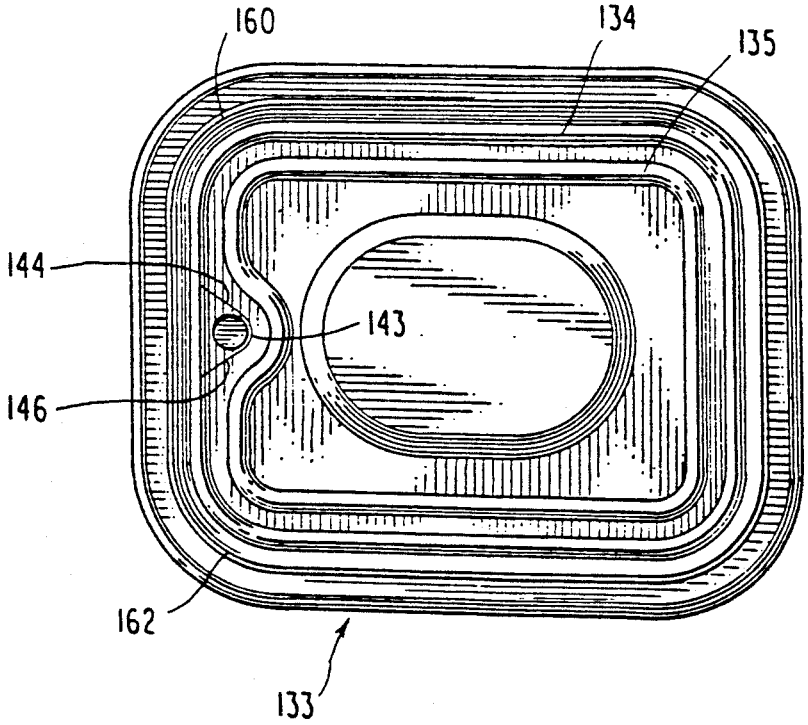
FIG. 21 is a bottom plan view of the end closure of FIG. 20.

An embodiment of the resulting end closure 133 with integral opener is shown in top plan view in FIG. 20, and a bottom plan view is shown in FIG. 21. Profiling ribs 134, 135 extend around the panel to help provide stiffening for the opening method described later herein.

An enlarged cross-sectional partial view (FIG. 22) is taken in a plane which includes the major dimensional axis of the end closure and the longitudinal axis of an integral opener. In such partial view, the orientation of the rounded edged portion 128 and chisel point working edge 136 of opener 138 is shown in relation to scoreline 102 which is contiguous to chuck wall 100. Integral opener 138 is longitudinally rigid; that is, free of any "lancing" along its length.

Referring to FIGS. 20, 21, 22, back scoreline 140 has an arch-shaped configuration which is positioned as shown in relation to rivet 142. Central portion 143 of the back scoreline 140 partially circumscribes the rivet. Back scoreline leg portions 144 and 146 extend, one on each side of the rivet, from such central portion 143 toward the adjacent portion of the multi-layer which extends around the perimeter of the endwall panel 112 contiguous to peripheral scoreline 102. Handle end 148 of integral opener 138 extends over finger access panel 159.

The central curved portion 143 of the back scoreline 140, ruptures first as integral opener handle end 148 is lifted away from the endwall panel 112 in an arcuate direction as indicated by arrow 150 of FIG. 23. Such initial rupture of the back scoreline is by Class II lever action and provides momentum for continued movement of the opener in such arcuate direction, as shown in FIG. 24, the chisel point working end 136 of the opener ruptures the peripheral scoreline 102.

Such arcuate direction of movement of the handle end 148 continues in excess of 90° (FIG. 25) in the same direction as indicated by arrow 150, until the opener contacts chime seam 151. Such angle of arcuate movement for the opener at which chime seam contact occurs is dependent on the amount of countersinking and the configuration of the opener; it is greater than 90° and, less than 180°.

Chime 151 acts as the fulcrum for continued arcuate movement of the opener as shown in FIG. 25. As seen in the top plan view of FIG. 26, the opener 138 has its handle end 148 exterior to the profile of the container side wall. Such handle end 148 is "outboard" of chime seam 151 such that downward ("{over-the-side") force on such handle end of the longitudinally-rigid opener, in the same direction as indicated by arrow 150 in FIG. 25, exerts a lifting action, as indicated by arrow 152 of FIG. 25, at the working end of the opener on the endwall panel.

The Class I lever action in the direction of arrow 152 of FIG. 25 further ruptures the peripheral scoreline and continues such rupture of peripheral scoreline (102) around corner portions 160 and 162 (FIG. 20). The lifting action of the longitudinally-rigid opener 138 indicated by arrow 152 acts on the endwall panel through the multilayer fold 127 which retains opener 138 with endwall panel 112 after severance of the back scoreline. Such "over-the-side", Class I lever action, lifting force on such endwall panel utilizes the contact between the chime seam metal and the longitudinally-rigid opener as a fulcrum.

The stiffening of the endwall panel brought about by the profiling beads 134, 135 facilitates such continued rupture of the peripheral scoreline brought about by such downward force on the "over-the-side" handle 140.

The initial rupture of the central portion 143 of the back scoreline 142 vents the container 153 and gives impetus to continued arcuate movement which provides a "snap-action" rupture of the peripheral scoreline.

The back scoreline legs 144, 146 extend toward the adjacent portion of multi-layer sheet metal fold 127; but, scoring for such legs terminates before actual intersection with such fold of metal layers (as indicated FIG. 21); also, the strength of such multi-layer fold 127 prevents ripping of the metal defined by the back scoreline from the endwall panel 112. Also, as mentioned, such multi-layer sheet metal provides the means for lifting of the panel by the lever action about chime 151 as a fulcrum. Such lifting action ruptures remaining peripheral scoreline 102 along the selected side for location of the rivet and opener; and, along the remaining dimension sides of the end closure. After such lever action opening, lifting of the opener 138 removes the panel to complete rupture of scoreline 102.

FIGS. 27, 28 and 29 set forth various views for describing the unique configuration of (wall support) chuck 170 of tooling 172. Chuck 170 protrudes as shown in cross-sectional view in FIG. 29 from the base of tooling 172, with a plan view configuration as shown in FIG. 27. Such plan view configuration fits within the interior surface of the chuck wall of an end closure to provide support for such chuck wall during chime seam formation.

Such chuck wall support is essential for chime seam formation because of the substantial lateral force required to curl and roll end closure perimeter metal and container body flange metal. A significant contribution of the invention relates to enabling such chuck wall support around the full chuck wall interior surface while providing access under chuck 170 for desired location of the working end of an integral opener (as positioned at one of the pre-selected locations described in relation to FIGS. 5 through 9). Such chisel-point working end of the opener is received in a cut-away access in chuck 170 which enables positioning such working end chisel-point contiguous (the plane of the endwall panel) to the peripheral scoreline to be ruptured and to the chuck wall while maintaining the desired strength for chuck 170.

In the embodiment of FIGS. 27 through 29, chuck wall support tooling 172 is of rectangular configuration (for the embodiment shown) in the plan view of FIG. 27. Configurations for the other embodiments (FIGS. 6 through 9) can readily be devised from the present teachings.

The rectangular chuck configuration for a rectangular end closure embodiment provides for a selection of an integral opener rivet location at either end of the longer dimension centerline axis 174 (FIG. 27). Therefore, such cut-away, access portions for such possible integral opener locations at opposite ends of such axis are at 176 and 177 in FIG. 27.

Cut-away portion 176 is shown in cross section in FIG. 28. Chuck wall support surface 178 has a decreased thickness as it approaches the distal end of the chuck as shown in FIG. 27. A short length along its perimeter at such distal end of reduced thickness also occurs. The cut-away access is supported by contiguous portions of the chuck 170 which continues above such location and around the perimeter. Angled cut-away portion 180 allows the working end of an opener (as indicated in interrupted lines at 182) to be positioned as desired in its initially secured position contiguous to the peripheral scoreline to be ruptured during formation of a chime seam.

Typical specifications are as follows:

| | | |
|---|---|---|
| Sheet Metal: | | |
| Steel | About 70 to 90 #/bb flat rolled steel, CDC treated flat rolled steel, tinplate or TFS with an organic coating having a nominal thickness of about .008" to about .010". | |
| Aluminum | .010 to .014" | |
| Scoreline: | Steel | Aluminum |
| Peripheral Residual Metal Thickness | .002-.003" | .0045-.0055" |
| Back Residual Metal Thickness | .002-.003" | .0045-0055" |
| Rectangular Configuration | Longer Dimension | Shorter Dimension |
| End Closure | 3 3/16" (303) | 2 8/16" (208) |
| Separable Endwall Panel | 3.04" × | 2.4" |
| Profiling Ribs: | | |
| Outer | .277" | 2.1" |
| Inner | .237" | 1.7" |
| Chime Seam Metal Periphery | 3.6" | 2.9" |
| Stepped Configuration: | .27" | |
| Chuck Wall Height: | .16" | |
| End Wall Panel | | |
| Corner Radius (Plan View) | .6" | |
| Profiling Ribs depth | .02" | |
| Finger Access Panel depth | .03" | |
| Rivet | | |
| Height | .045" | |
| Diameter | 0.20" | |

Preferably, the elongated longitudinally rigid opener is made from flat-rolled steel of about 0.012" nominal thickness gage to about 0.017" nominal thickness gage, if made from aluminum the thickness gage would extend from about 0.012" to about 0.022". The overall length of such opener for the above described 303×208 end closure is about 1.5". The opener sheet metal is longitudinally reinforced about the rivet as well as by curling of the edge metal along its length and around a ring-shaped opening when such an opening is used. Edge metal curling techniques are known in the art. The sheet metal of the opener about the rivet is not lanced; rather, the back scoreline, as described above, ruptures while the opener retains its longitudinally-rigid characteristic for the various lever-action opening functions described.

Specific details of a non-circular configuration end closure, along with materials and dimensions have been set forth;, along with other non-circular configurations, to provide a better understanding of the invention; however, in the light of such teachings, the specific values can be modified by those skilled in can making while relying on the new concepts taught herein; therefore, in interpreting the scope of the present invention reference shall be had to the appended claims.

I claim:

1. A non-cylindrical convenience-feature sheet metal end closure for providing an unobstructed opening for removal of solid-pack contents as a single piece from a container body having a non-cylindrical configuration side wall comprising:

a generally-planar sheet metal endwall panel of the same non-circular configuration as the container side walls;

unitary chime seam metal circumscribing the endwall panel for securing the end closure to the container body;

the endwall panel having a public side and a product side and being recessed axially, in relation to the chime seam metal, in the direction of its product side; such recessed portion forming a chuck wall extending circumferentially around the endwall panel and axially inwardly in the direction of the product side so as to extend between the chime seam metal and the axially recessed endwall panel, the chuck wall being substantially perpendicular in cross-sectional view to a plane defined by the generally-planar axially-recessed endwall panel;

a peripheral scoreline of decreased sheet metal thickness in the endwall panel contiguous to the chuck wall and having substantially the same non-circular configuration and dimensions in plan view of the end closure as the non-cylindrical configuration of the container body side wall;

the peripheral scoreline extending about the entire non-circular periphery of the axially-recessed endwall panel contiguous to such chuck wall so as to define a separable panel in the endwall panel enabling unobstructed removal of solid-pack contents from the container body in one piece upon removal of the separable panel after severance of the peripheral scoreline;

an elongated, longitudinally-rigid sheet metal opener having a longitudinal axis;

securing means securing the opener to the separable panel with the longitudinal axis of the opener coinciding with a centrally-located major linear dimensional axis of the endwall panel;

the elongated opener having a working end and a handle end at its longitudinally opposite ends, the working end being positioned contiguous to the chuck wall and to a preselected starter portion of the peripheral scoreline at which rupture is initiated;

the location of the working end of the opener contiguous to the chuck wall being positioned such as to rupture the starter portion of the peripheral scoreline upon arcuate movement of the handle end of the opener in a direction outwardly away from the panel;

back scoreline means of decreased sheet metal thickness being positioned in the separable panel and having a central portion partially circumscribing the securing means and located generally inwardly of the securing means toward the geometric center of the endwall panel;

a pair of scoreline legs extending from the central portion of the back scoreline means with one each of the pair of legs on an opposite side of the securing means and extending toward the starter portion of the peripheral scoreline, the relative positions of the back scoreline means, the securing means, the elongated opener, and the chime seam being such that the central portion of the back scoreline means is ruptured by Class 2 lever action during the initiating of movement of the handle end of the opener in an arcuate direction externally away from the separable panel, and the peripheral scoreline starter portion is ruptured by Class 1 lever action during such arcuate direction movement of the handle end of the elongated opener, and continued arcuate movement of the handle end of the elongated opener establishes contact of the elongated opener with the chime seam metal and the chime seam metal then acts as a fulcrum for continued lever action severance of the peripheral scoreline, in which position the handle end of the opener is disposed exterior to the container sidewall with the working end of the elongated opener acting on an internally-oriented location of the separable panel as a Class 1 lever so as to forcibly lift the separable panel in a direction outwardly of the container as such arcuate movement continues to greater than 90° from the original position of the handle end of the opener.

2. The structure of claim 1 in which:

the sheet metal end closure comprises flat-rolled steel having a nominal thickness in the range of about 0.008" to about 0.010" with residual metal thickness along such peripheral and back scoreline means in the range of about 0.002" to 0.003", and such opener is formed from flat-rolled steel having a nominal thickness gage in the range of about 0.012" to about 0.017".

3. The structure of claim 1 which the sheet metal end closure comprises flat-rolled aluminum having a thickness gage of about 0.010" to about 0.014" with residual metal thickness along such peripheral and back scoreline means in the range of about 0.0045" to about 0.0055" and the opener is formed from flat-rolled aluminum having a thickness gage in the range of about 0.012" to about 0.022".

4. The structure of claim 1 in which the distance between the chuck wall and the peripheral scoreline is such that the portion of the endwall panel remaining attached to the endwall closure after opening of the container is about the same as that remaining on a conventional container after opening with a conventional roll-knife can opener such that no dangerous edge of the endwall panel is present, and the entire solid-pack contents can be removed in one piece, upon removal of the separable panel.

5. The structure of claim 1 further including means for shielding severed residual metal of the peripheral scoreline on the separable endwall panel, the shielding means comprising multiple layers of endwall panel sheet metal folded in overlaying relationship with each other, with the multiple-layer sheet metal fold peripherally circumscribing and being nested against the product side of the separable panel contiguous to the peripheral scoreline of the endwall panel, and the back scoreline legs terminate contiguous to the multiple-layer sheet metal fold such that the sheet metal layers of the fold disposed about the periphery of the panel prevent rupturing of the back scoreline legs from extending through the multiple-layers of sheet metal and thereby preventing severance of a portion of the endwall panel adjacent the starter segment of the peripheral scoreline from being separated from the remainder of separable panel during opening so that the elongated opener is retained with the separable panel.

* * * * *

UNITED STATES PATENT AND TRADEMARK OFFICE

CERTIFICATE OF CORRECTION

PATENT NO. : 5,217,134
DATED : June 8, 1993
INVENTOR(S) : Saunders

It is certified that error appears in the above-identified patent and that said Letters Patent is hereby corrected as shown below:

Title page,
Item [*] Notice, please delete "The portion of the term of this patent subsequent to Feb. 14, 2006 has been disclaimed." and insert -- This patent is subject to a terminal disclaimer. --.

Signed and Sealed this

Eighteenth Day of October, 2005

JON W. DUDAS
*Director of the United States Patent and Trademark Office*